US008453952B2

(12) United States Patent
Masuda

(10) Patent No.: US 8,453,952 B2
(45) Date of Patent: Jun. 4, 2013

(54) ELECTROSTATIC ATOMIZING DEVICE

(75) Inventor: Yukihiro Masuda, Kadoma (JP)

(73) Assignee: Panasonic Corporation, Osaka (JP)

( * ) Notice: Subject to any disclaimer, the term of this patent is extended or adjusted under 35 U.S.C. 154(b) by 128 days.

(21) Appl. No.: 12/918,707

(22) PCT Filed: Feb. 17, 2009

(86) PCT No.: PCT/JP2009/052674

§ 371 (c)(1),
(2), (4) Date: Aug. 20, 2010

(87) PCT Pub. No.: WO2009/107515

PCT Pub. Date: Sep. 3, 2009

(65) Prior Publication Data

US 2011/0006139 A1 Jan. 13, 2011

(30) Foreign Application Priority Data

Feb. 27, 2008 (JP) ..... 2008-046548

(51) Int. Cl.
*B05B 5/00* (2006.01)

(52) U.S. Cl.
USPC ..... 239/690; 239/302; 239/288; 239/690.1; 118/621; 62/373

(58) Field of Classification Search
USPC .... 239/690, 690.1, 302, 288–288.5; 118/621; 62/373
See application file for complete search history.

(56) References Cited

U.S. PATENT DOCUMENTS 3,735,925 A * 5/1973 Benedek et al. ..... 118/621

FOREIGN PATENT DOCUMENTS

| | | | |
|---|---|---|---|
| JP | 7-106052 | A | 4/1995 |
| JP | 2003-178854 | A | 6/2003 |
| JP | 2005-131549 | A | 5/2005 |
| JP | 2006-50965 | A | 2/2006 |

OTHER PUBLICATIONS

International Search Report for the Application No. PCT/JP2009/052674 mailed Mar. 24, 2009.

* cited by examiner

*Primary Examiner* — Steven J Ganey
(74) *Attorney, Agent, or Firm* — McDermott Will & Emery LLP

(57) ABSTRACT

The electrostatic atomizing device includes a discharge electrode and an opposed electrode provided with an aperture. The opposed electrode has its inner surface opposed to the discharge electrode. The inner surface is a recessed surface which surrounds a tip of the discharge electrode. The inner surface has at least one part shaped into a spherical surface which is centered on the tip of the discharge electrode and has a constant radius. The opposed electrode is provided with a cylindrical electrode extending from a periphery of the aperture away from the discharge electrode.

4 Claims, 5 Drawing Sheets

ELECTROSTATIC ATOMIZING DEVICE

TECHNICAL FIELD

The present invention is directed to an electrostatic atomizing device which generates a mist of charged minute water particles.

BACKGROUND ART

In the past, as disclosed in Japanese laid-open patent publication No. 2005-131549, there is known an electrostatic atomizing device. The electrostatic atomizing device disclosed in the aforementioned Japanese laid-open patent publication includes a discharge electrode, an opposed electrode spaced from the discharge electrode, a water transporter (liquid supplying means) configured to supply a liquid for atomizing to the discharge electrode, and a high voltage application unit (high voltage applying means) configured to apply a high voltage between the discharge electrode and the opposed electrode. In the electrostatic atomizing device, the high voltage application unit develops an electric field between the opposed electrode and the discharge electrode to concentrate negative electric charges on the liquid held by the discharge electrode, thereby generating an electrostatic atomizing phenomenon where the liquid disintegrates and spreads repeatedly (Rayleigh disintegration). This electrostatic atomizing phenomenon causes a generation of a mist of charged minute water particles of nanometer sizes which contain radicals (active species). The mist of charged minute water particles is discharged out as being carried on an air flow caused by an ionic wind. Consequently, the electrostatic atomizing device can produce such as high moisturizing action, a deodorization effect, and an inactivation effect for allergens (e.g. ticks and pollens).

The opposed electrode of the aforementioned electrostatic atomizing device is shaped into a ring shape provided with an aperture (emitter port) in its center. This opposed electrode is disposed with a tip of the discharge electrode exposed in the aperture. Thus, the high voltage application unit develops an electric field which extends between an inner surface of the opposed electrode and the tip of the discharge electrode, and which becomes strong only in a narrow region between the tip of the discharge electrode and a periphery of the emitter port. Therefore, a concentration of an electric field on the tip of the discharge electrode is relatively low. Accordingly, it is difficult to generate and discharge a large amount of charged minute water particles containing radicals.

DISCLOSURE OF INVENTION

In view of the above insufficiency, the present invention has been aimed to propose an electrostatic atomizing device which is capable of developing an electric field between the discharge electrode and the opposed electrode while promoting concentration of the electric field at the tip of the discharge electrode, thereby for generating and discharging a large amount of a mist of charged minute water particles containing radicals.

The electrostatic atomizing device in accordance with the present invention includes a discharge electrode, an opposed electrode spaced from the discharge electrode, a liquid supplying means configured to supply a liquid to a tip of the discharge electrode, and a voltage applying means configured to apply a voltage between the tip of the discharge electrode and the opposed electrode to produce a mist of charged minute water particles from the liquid supplied to the tip of the discharge electrode. The opposed electrode is provided with an aperture for discharging the mist of charged minute water particles outwardly therethrough. The opposed electrode is shaped to have a recessed surface which is opposed to the discharge electrode and surrounds the tip of the discharge electrode. The opposed electrode is provided with a cylindrical electrode extending from a periphery of the aperture away from the discharge electrode.

According to the present invention, an intense electric field is generated between the tip of the discharge electrode and the surface of the opposed electrode in the discharge electrode side to cover an extensive range. In addition, an electric field is generated also in a clearance between the inner periphery of the cylindrical electrode and the tip of the discharge electrode. Therefore, a concentration of an electric field at the tip of the discharge electrode greatly increases. Consequently, electric charges become effectively concentrated on the liquid carried on the discharge electrode. Accordingly, it is possible to generate a large amount of the mist of charged minute water particles containing radicals. In addition, the mist of charged minute water particles goes into the aperture of the opposed electrode as being attracted to the inner periphery of the cylindrical electrode. Thereafter, the mist of charged minute water particles passes within the cylindrical electrode followed by being discharged out through the discharge port. Consequently, it is possible to discharge out a large amount of the mist of charged minute water particles containing the radicals.

In a preferred embodiment, the recessed surface comprises a spherical surface which is centered on the tip of the discharge electrode and has a constant radius.

According to the invention, it is possible to generate an intense electric field between the tip of the discharge electrode and at least one part of the surface to cover an extensive range.

In a preferred embodiment, the cylindrical electrode has its axial direction which is aligned with a radial direction of the spherical surface passing through the center of the aperture.

According to the invention, it is possible to discharge the mist of charged minute water particles out through the aperture without retaining the mist of the charged minute water particles on the inner surface of the opposed electrode as less as possible.

In a preferred embodiment, the electrostatic atomizing device satisfies a relation of $0.1<D/2R<1$, wherein D is an inner diameter of the cylindrical electrode, and R is the radius of the spherical surface.

According to the invention, it is possible to keep an amount of radicals in an efficient range as an assured performance range.

BEST MODE FOR CARRYING OUT THE INVENTION

Figure 1:
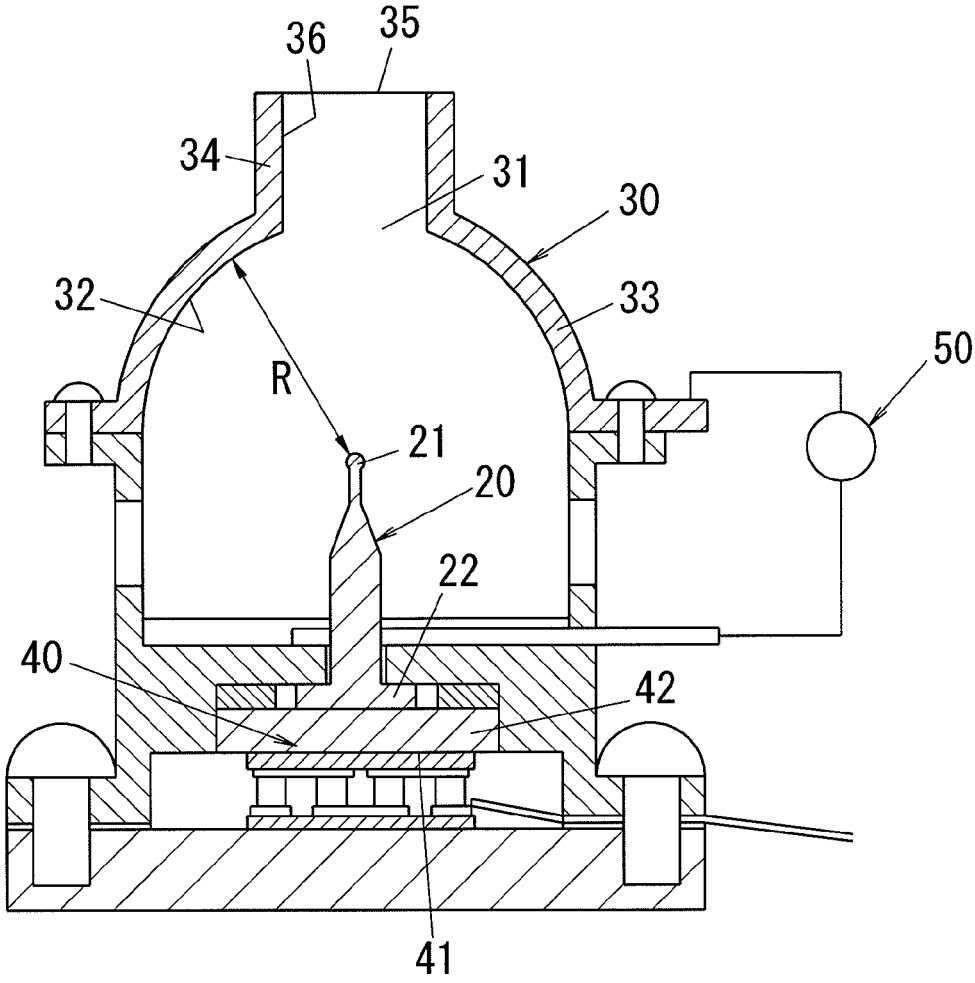
FIG. 1 is a schematic cross sectional view illustrating an electrostatic atomizing device of one embodiment in accordance with the present invention.

FIG. 1 shows a schematic view of an electrostatic atomizing device 10 of one embodiment in accordance with the present invention. The electrostatic atomizing device 10 of the present embodiment includes a discharge electrode 20, an opposed electrode 30, a liquid supply device (liquid supplying means) 40, and a voltage application device (high voltage applying means) 50.

The discharge electrode 20 is shaped into a bar shape. The discharge electrode 20 further has its tip 21 shaped into a spherical shape. By contrast, the discharge electrode 20 has its base 22 shaped into a plate shape. In addition, the discharge electrode 20 is made of a material (e.g. aluminum) having high heat conductivity in metals. It is noted that the tip 21 of the discharge electrode 20 may have not a spherical shape but a sharp shape.

The voltage application device 50 is electrically connected to each of the discharge electrode 20 and the opposed electrode 30 and is configured to apply a voltage between the discharge electrode 20 and the opposed electrode 30. The voltage application device 50 is configured to apply between the discharge electrode 20 and the opposed electrode 30 an enough voltage to generate the mist of charged minute water particles from a liquid carried on the tip of the discharge electrode 20. Further, the voltage application device 50 is configured to apply a voltage between the discharge electrode 20 and the opposed electrode 30 such that the tip 21 of the discharge electrode 20 acts as a negative electrode, thereby concentrating electric charges on the tip 21 of the discharge electrode 20.

The liquid supply device 40 is configured to supply a liquid for electrostatic atomization (not shown) to the tip 21 of the discharge electrode 20. In the present embodiment, water is adopted as the liquid for electrostatic atomization. The liquid supply device 40 is realized by use of the discharge electrode 20 and a pettier unit 41. The peltier unit 41 has its cooling portion 42 contacting with the base 22 of the discharge electrode 20. In other words, the cooling portion 42 is thermally coupled to the base 22 of the discharge electrode 20. The liquid supply device 40 is configured to cool the discharge electrode 20 below a dew point of circumambient air by controlling the pettier unit 41. That is, the liquid supply device 40 supplies water to the tip 21 of the discharge electrode 20 by use of dew condensation (surface condensation). In the electrostatic atomizing device 10, water (dew condensation water) existing on the surface of the discharge electrode 20 by dew condensation is adopted as the liquid for electrostatic atomization. The liquid supply device 40 is not limited to the aforementioned instance. For example, the liquid supply device 40 may be realized by use of the discharge electrode 20 and a liquid tank (not shown) configured to store the liquid. In this case, the discharge electrode 20 may be made of a material having fine pores or a porous material (e.g. a porous ceramics and the like), and may be disposed with its base 22 soaked in the liquid stored in the liquid tank.

The opposed electrode 30 has a main body 33 formed into a hemispherical dish shape and made of metals. The main body 33 is provided in its center with an aperture (hereinafter referred to as "first aperture") 31 for discharging the mist of charged minute water particles outwardly therethrough. The opposed electrode 30 is spaced from the discharge electrode 20 with the inner surface 32 of the main body 33 being directed toward the discharge electrode 20. In short, the inner surface 32 of the opposed electrode 30 defines a surface of the opposed electrode opposed to the discharge electrode 20.

This inner surface 32 is a recessed surface (concave surface) which surrounds the tip 21 of the discharge electrode 20. When viewed in a cross section of the opposed electrode 30 corresponding to a plane passing through the tip 21 of the discharge electrode 20, an outline of the inner surface 32 is an arc centered on the tip 21 of the discharge electrode 20 with its radius equal to a shortest distance (that is, discharge distance) R between the tip 21 and the opposed electrode 30.

Figure 2A:
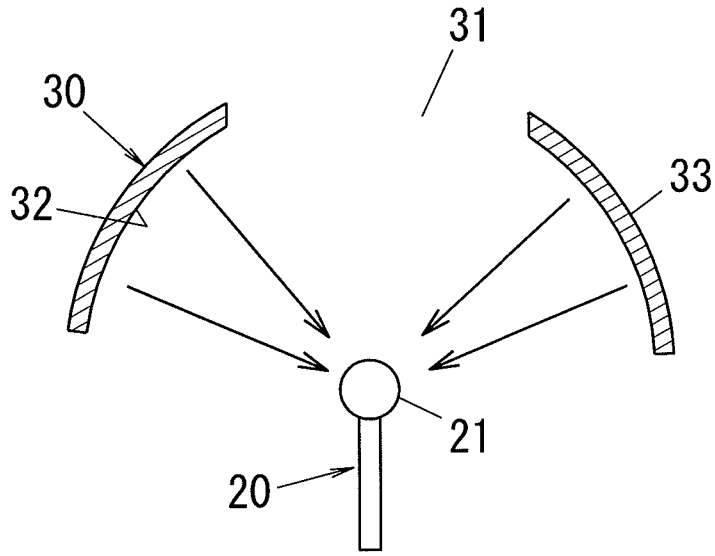
FIG. 2A is an explanatory view illustrating an electric field between a discharge electrode and an opposed electrode under a condition where the opposed electrode is not provided with a cylindrical electrode.

Especially, in the present embodiment, the inner surface 32 of the opposed electrode 30 includes a spherical surface (hemispherical surface) which is centered on the tip 21 of the discharge electrode 20 and has a constant radius R. That is, the entire main body 33 of the opposed electrode 30 having the inner surface 32 surrounding the tip 21 of the discharge electrode 20 is defined as a portion where a distance between the opposed electrode 30 and the tip 21 of the discharge electrode 20 is the shortest distance R. Therefore, an intense electric field is generated between the entire main body 33 and the tip 21 of the discharge electrode 20 to cover a three-dimensional extensive range (see an arrow shown in FIG. 2A).

The opposed electrode 30 is further provided with a cylindrical electrode 34. The cylindrical electrode 34 is made of metals and has its opposite ends opened. The cylindrical electrode 34 extends from a periphery of the first aperture 31 away from the discharge electrode 20 (toward the upper direction in FIG. 1). The cylindrical electrode 34 has its inside communicating to the first aperture 31 of the opposed electrode 30 at a first axial end (a lower end in FIG. 1). The cylindrical electrode 34 has its inside communicating to an outside at a second axial end (an upper end in FIG. 1). Therefore, in the electrostatic atomizing device 10, an opening 35 at the second axial end of the cylindrical electrode 34 is used as a discharge port for the mist of charged minute water particles. The opening 35 is hereinafter referred to as "discharge port".

Figure 2B:
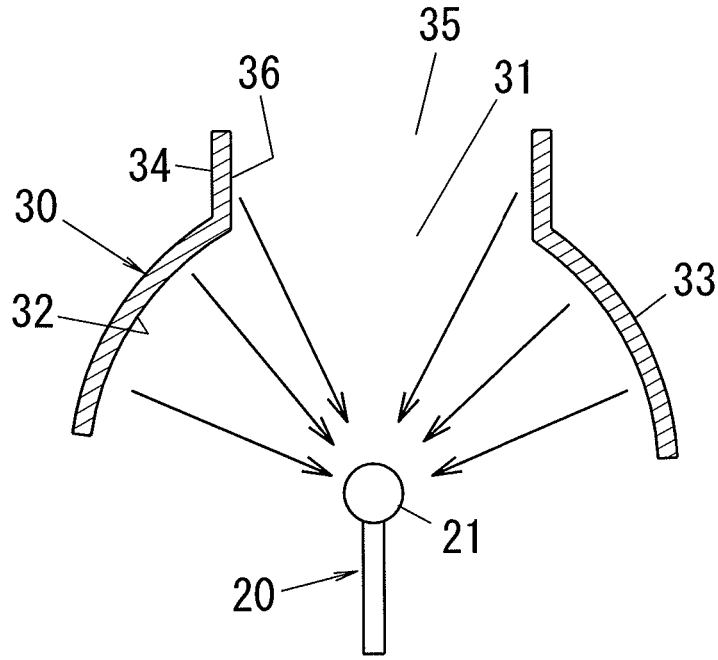
FIG. 2B is an explanatory view illustrating an electric field between the discharge electrode and the opposed electrode under a condition where the opposed electrode is provided with the cylindrical electrode.

The cylindrical electrode 34 is integrally formed with the main body 33. Therefore, the cylindrical electrode 34 is electrically connected to the main body 33. Accordingly, when the voltage application device 50 applies a voltage between the discharge electrode 20 and the opposed electrode 30, the voltage is applied not only between the discharge electrode 20 and the main body 33 but also between the discharge electrode 20 and the cylindrical electrode 34. Thus, an intense electric field is generated between an entire inner periphery 36 of the cylindrical electrode 34 and the tip 21 of the discharge electrode 20 to cover a three-dimensional extensive range (see an arrow shown in FIG. 2B).

Therefore, an electric field generated three-dimensionally between the entire inner periphery 36 of the main body 33 and the tip 21 of the discharge electrode 20 is added to an electric field generated three-dimensionally between the entire inner surface 32 of the main body 33 and the tip 21 of the discharge electrode 20, thereby developing an intense electric field between the opposed electrode 30 and the tip 21 of the discharge electrode 20.

The main body 33 and the cylindrical electrode 34 are integrally formed with each other by cutting and bending a conductive material being a metal such as SUS304. Alternatively, the main body 33 and the cylindrical electrode 34 can be a metal plated molded article. Moreover, a conductive plastic can be adopted as the conductive material of the main body 33 and the cylindrical electrode 34.

Next, a brief explanation is made to an operation where the electrostatic atomizing device 10 generates the mist of charged minute water particles. First, the liquid supply device 40 supplies the liquid to the tip 21 of the discharge electrode 20. Thereby the discharge electrode 20 carries the liquid at the tip 21 thereof. Thereafter, the voltage application device 50 applies the voltage between the discharge electrode 20 and the opposed electrode 30. The resultant electric field charges the liquid carried on the tip 21 of the discharge electrode 20 to develop a Coulomb force at the liquid which causes the liquid surface to bulge conically and locally. Then, electric charges become concentrated at a tip of the conical shaped liquid (Taylor cone) to increase its charge density. When the charge density becomes high, an electrostatic atomizing phenomenon occurs. In the electrostatic atomizing phenomenon, the liquid disintegrates and spreads repeatedly (Rayleigh disintegration) by a repulsion force caused by high-density charges, as burst. The electrostatic atomizing phenomenon generates a large amount of the mist of charged minute water particles which are of nanometer sizes and include radicals (active species). The generated mist of charged minute water particles goes into the cylindrical electrode 34 through the first aperture 31 and is discharged out of the electrostatic atomizing device 10 through the discharge port 35, as being carried on an air flow caused by an ionic wind.

According to the electrostatic atomizing device 10 of the present embodiment, as described in the above, the intense electric field is developed in an extensive range between the opposed electrode 30 and the tip 21 of the discharge electrode 20. Therefore, the electric field concentrates extremely on the tip 21 of the discharge electrode 20. Thus, the charges are effectively concentrated on the liquid carried on the discharge electrode 20. Accordingly, a large amount of the mist of charged minute water particles is generated.

In addition, the mist of charged minute water particles goes into the first aperture 31 as being attracted to the inner periphery 36 of the cylindrical electrode 34. Thereafter, the mist of charged minute water particles passes within the cylindrical electrode 34 followed by being discharged out through the discharge port 35, as being carried on an air flow caused by an ionic wind.

Briefly, according to the electrostatic atomizing device 10 of the present embodiment, the electric field can concentrate extremely on the tip 21 of the discharge electrode 20 because the cylindrical electrode 34 extends from the periphery of the first aperture 31 of the main body 33. Therefore, a large amount of the mist of charged minute water particles including radicals can be generated. Further, it is possible to discharge with high efficiency the generated mist of charged minute water particles out through the first aperture 31 without retaining the mist of charged minute water particles on the inner surface 32 of the opposed electrode 30. As a result, a large amount of the mist of charged minute water particles is discharged out.

In the present embodiment, the cylindrical electrode 34 has its axial direction which is aligned with a particular normal direction (the upper direction in FIG. 1) of a circular arc which is centered on the tip 21 of the discharge electrode 20 and has the shortest distance R. Herein, the particular normal direction is defined as a normal direction of the circular arc passing through the center of the first aperture 31. That is, the cylindrical electrode 34 has its axial direction which is aligned with a radial direction of the spherical surface passing through the center of the first aperture 31.

Accordingly, the mist of charged minute water particles is hard to come into contact with the inner periphery 36 of the cylindrical electrode 34. Therefore, it is possible to discharge out the mist of charged minute water particles as being carried on an air flow caused by an ionic wind while reducing an amount of the mist of charged minute water particles retained on the inner periphery 36 of the cylindrical electrode 34 as less as possible. For example, when comparing two situations one with the electrostatic atomizing device 10 disposed with an axial direction of the cylindrical electrode 34 being inclined by 30 degree relative to the normal direction, and the other with the electrostatic atomizing device 10 disposed with the axial direction of the cylindrical electrode 34 being aligned with the normal direction as shown in FIG. 1, it is seen that the former reduces an amount of the mist of charged minute water particles discharged outwardly by more extent than the latter (an amount of the mist of charged minute water particles discharged outwardly from the former device becomes tenth part of that of the mist of charged minute water particles from the latter device).

Figure 3A:
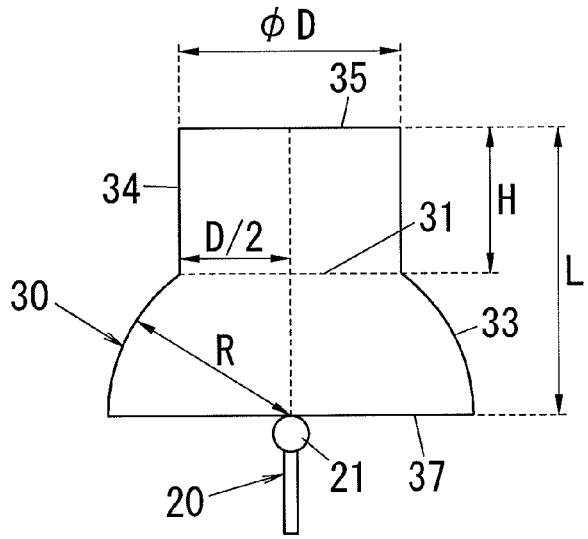
FIG. 3A is a schematic side view illustrating a dimension relation between the discharge electrode and the opposed electrode of the above electrostatic atomizing device.
Figure 3B:
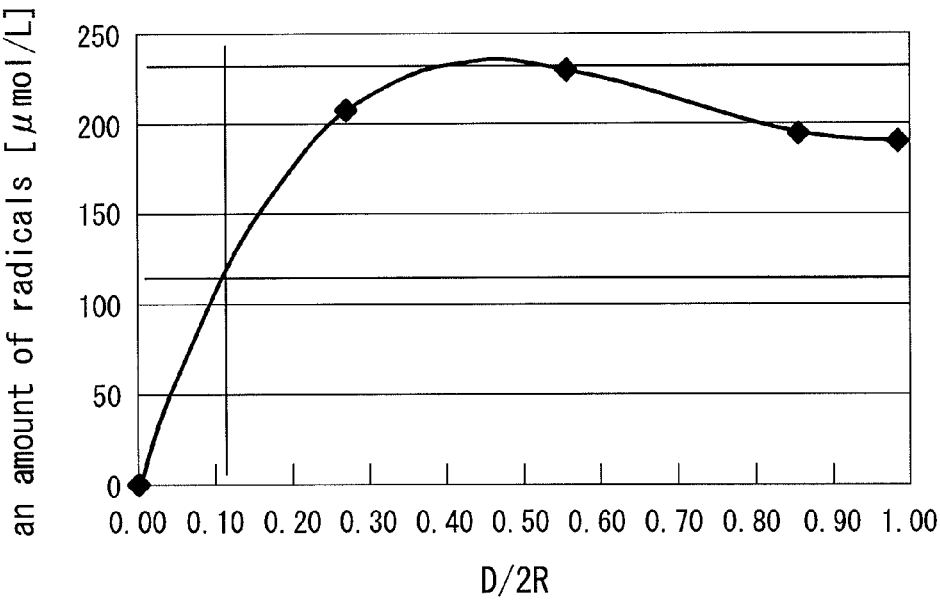
FIG. 3B shows a graph of dependency of an amount of radicals relative to the dimension relation shown in FIG. 3A.

FIG. 3B shows a relation between an amount of radicals to be discharged outwardly and dimensions of the discharge electrode 20 and the opposed electrode 30. As shown in FIG. 3A, D [mm] denotes an inner diameter of the cylindrical electrode 34, and H [mm] denotes a height (axial length) of the cylindrical electrode 34, and L [mm] denotes a height of the opposed electrode 30. The main body 33 of the opposed electrode 30 has an aperture (hereinafter referred to as "second aperture") 37 at the side of the discharge electrode 20. The height of the opposed electrode 30 is defined as a length from the second aperture 37 of the main body 33 to the discharge port 35 of the cylindrical electrode 34. It is noted that R has a unit of [mm]. Additionally, in the instance shown in FIG. 3A, the tip 21 of the discharge electrode 20 and the second aperture 37 of the opposed electrode 30 are located on the same level. Therefore, in the instance shown in FIG. 3A, a relation of $(L-H)^2+(D/2)^2=R^2$ is satisfied.

Herein, if D is variable while L is kept 7 [mm] and R is kept 5 [mm], H is determined depending on D by the aforementioned relation. As shown in FIG. 3B, an amount of radicals discharged out is variable depending on a proportion of D to 2R (that is, D/2R).

As shown in FIG. 3B, a radical peak where the radicals are generated and discharged with the highest efficiency is in a range of $0.4<D/2R<0.5$. This indicates that a proportion D/2 to R is required to satisfy a relation of $0.1<D/2R<1$ in order to keep an amount of the radicals not less than 50% of that generated at the radical peak for providing an assured performance range.

A following table 1 shows a result of an amount of the radicals under the same condition except for varying "H". The table 1 indicates that the height H of the cylindrical electrode 34 is preferred to satisfy a relation of $H\geqq 3$ [mm]. In table 1, an instance of H=0 [mm] denotes that the opposed electrode 30 is not provided with the cylindrical electrode 34. This result indicates that an amount of the radicals is greatly increased by providing the opposed electrode 30 to the cylindrical electrode 34.

TABLE 1

| the height H of the cylindrical electrode [mm] | the discharge starting voltage [kV] | the maximum electrical field intensity at the applied voltage being −5 kV [*1E7 V/m] | the amount of the radicals [μmol/L] |
|---|---|---|---|
| 0.0 | 3.6800 | 3.6501 | 195 |
| 1.5 | 3.6775 | 3.6580 | 200 |
| 3.0 | 3.6375 | 3.6725 | 230 |
| 4.5 | 3.6375 | 3.6731 | 230 |

Under the same condition except for varying "R", an amount of the radicals tends to increase as R increases. It is assumed that the tip 21 of the discharge electrode 20 receives considerable energy because the electrostatic atomizing phenomenon starts at a higher voltage as R increases with the result of that an amount of the radicals is greatly increased.

Figure 4A:
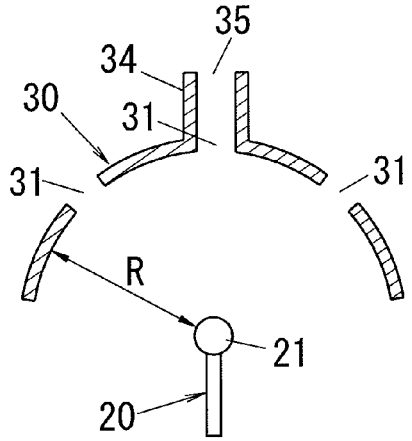
FIG. 4A is a schematic side view illustrating a modification of the above electrostatic atomizing device.
Figure 4B:
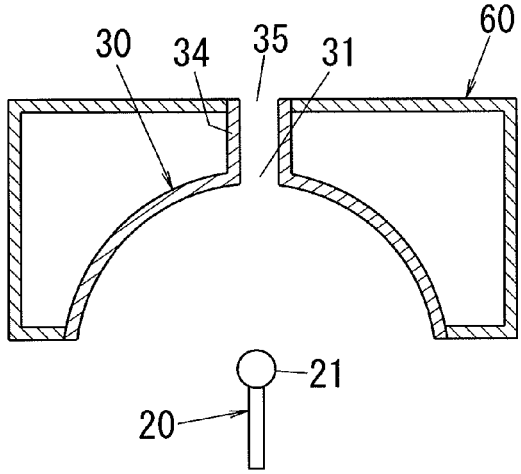
FIG. 4B is a schematic side view illustrating a modification of the above electrostatic atomizing device.
Figure 5:
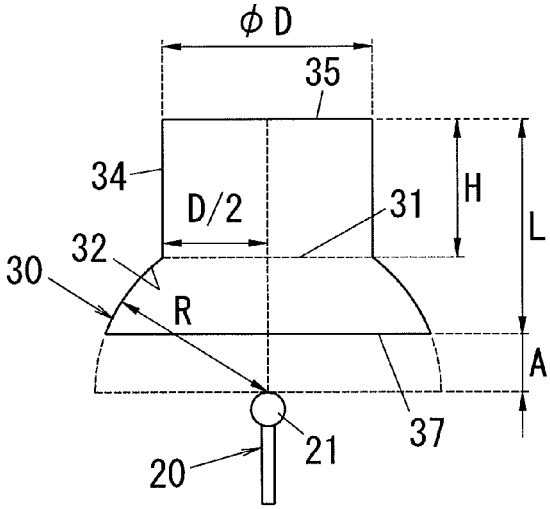
FIG. 5 is a schematic side view illustrating the dimension relation of a modification of the above electrostatic atomizing device.
Figure 6:
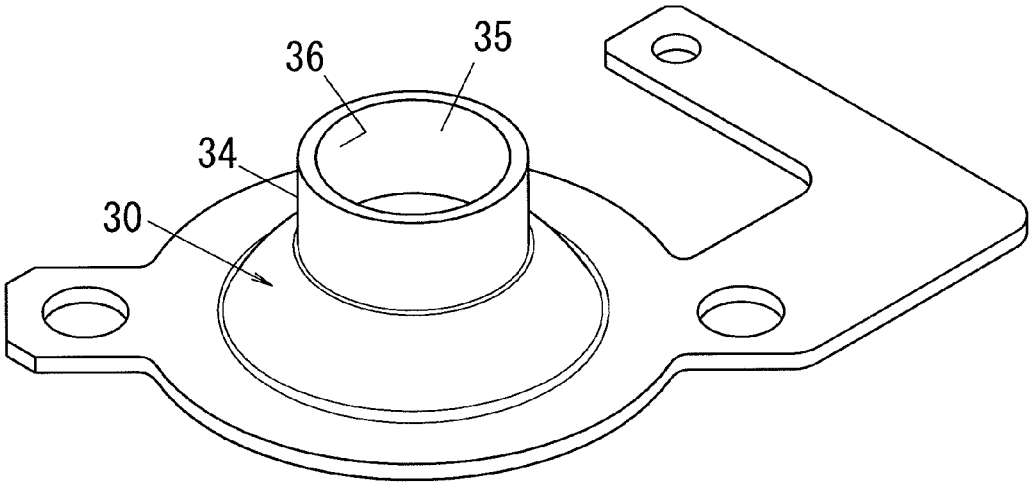
FIG. 6 is a perspective view illustrating the opposed electrode of a modification of the above electrostatic atomizing device.

FIGS. 4 to 6 show modifications, respectively. As briefly illustrated in FIG. 4A, the opposed electrode 30 may be provided with a plurality of the first apertures 31. In this instance, the cylindrical electrode 34 may extend from the periphery of at least one of the plurality of the first apertures 31 on an outer surface of the main body 33. The cylindrical electrode 34 is not required to give an external shape of a cylinder. For example, as briefly illustrated in FIG. 4B, the electrostatic atomizing device 10 may includes a holder 60 configured to hold the opposed electrode 34. The holder 60 is configured to cover the opposed electrode 30 so as to expose only the discharge port 35 of the cylindrical electrode 34.

In addition, the second aperture 37 of the opposed electrode 30 and the tip 21 of the discharge electrode 20 need not be located on the same level. For example, as shown in FIGS. 5 and 6, the electrostatic atomizing device 10 may be configured such that a distance between the second aperture 37 and the tip 21 of the discharge electrode 20 is "A" [mm]. Hereinafter, the distance between the second aperture 37 and the tip 21 of the discharge electrode 20 is defined as a lift "A" [mm]. Therefore, in the instance shown in FIG. 5, a relation of $[(L+A)-H]^2+(D/2)^2=R^2$ is satisfied.

In an instance shown in FIGS. 5 and 6, the lift "A" is provided and the main body 33 of the opposed electrode 30 is configured into a shallow shape so as not to conceal the tip 21 of the discharge electrode 20 when viewed from sideward. Also in this instance, an amount of the radicals can be maintained by satisfying the relation of $0.1<D/2R<1$. However, in this instance, a relation of $2*(R^2-A^2)^{1/2}>D$ needs to be satisfied. For example, L=3.83 [mm], R=5 [mm], H=1.5 [mm], D=5 [mm], and A=2 [mm].

In addition, when viewed in a cross section of the opposed electrode 30, an outline of the inner surface 32 need not be identical exactly to the arc centered on the tip 21 of the discharge electrode 20 and having the radius R. That is, the outline of the inner surface 32 is allowed to be similar to the aforementioned arc. For example, the outline may be a polygonal curve composed of a plurality of linear lines connected to each other. In this instance, the inner surface 32 of the main body 33 of the opposed electrode 30 is a recessed surface shaped into a hemispherical shape by combining a plurality of flat surfaces spaced from the tip 21 of the discharge electrode 20 by the radius R.

Moreover, the inner surface 32 of the opposed electrode 30 is not limited to the hemispherical recessed surface. For example, the opposed electrode 30 may have a structure where an electrode plate is bent to have an inverted U-shape. Also in such an instance, it is sufficient that, when viewed in the cross section of the opposed electrode 30, the opposed electrode 30 is formed such that at least one part of the outline of the inner surface 32 extends along the arc centered on the tip 21 of the discharge electrode 20 and having the radius R. Of course, also in this instance, when viewed in the cross section of the opposed electrode 30, the outline of the inner surface 32 may be a polygonal curve composed of a plurality of linear lines connected to each other.

The invention claimed is:

1. An electrostatic atomizing device comprising:

a discharge electrode;

an opposed electrode spaced from said discharge electrode;

a liquid supplying device configured to supply a liquid to a tip of said discharge electrode; and a voltage applying device configured to apply a voltage between said tip of said discharge electrode and said opposed electrode to produce a mist of charged minute water particles from the liquid supplied to said tip of said discharge electrode, wherein said opposed electrode is provided with an aperture for discharging the mist of charged minute water particles outwardly therethrough, said opposed electrode being shaped to have a recessed surface which is opposed to said discharge electrode and surrounds said tip of said discharge electrode, said opposed electrode being provided with a cylindrical electrode extending from a periphery of said aperture away from said discharge electrode, and when viewed in a cross section of said opposed electrode, said opposed electrode is formed such that at least one part of an outline of said recessed surface extends along an arc centered on said tip of said discharge electrode with its radius equal to a shortest distance between said tip and said recessed surface.

2. An electrostatic atomizing device as set forth in claim 1, wherein said recessed surface comprises a spherical surface which is centered on said tip of said discharge electrode and has a constant radius.

3. An electrostatic atomizing device as set forth in claim 2, wherein said cylindrical electrode has its axial direction which is aligned with a radial direction of said spherical surface passing through the center of said aperture.

4. An electrostatic atomizing device as set forth in claim 2, wherein said electrostatic atomizing device satisfies a relation of $0.1<D/2R<1$, wherein D is an inner diameter of said cylindrical electrode, and R is the radius of said spherical surface.

* * * * *